US009132395B2

(12) United States Patent
Schauerte et al.

(10) Patent No.: US 9,132,395 B2
(45) Date of Patent: Sep. 15, 2015

(54) APPARATUS FOR MIXING A POWDERY MEDIUM WITH A FLUID

(75) Inventors: Manfred Schauerte, Schmallenberg (DE); Markus Hamers, Lennestadt (DE); Meinolf Rameil, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 652 days.

(21) Appl. No.: 12/908,212

(22) Filed: Oct. 20, 2010

(65) Prior Publication Data

US 2011/0090757 A1 Apr. 21, 2011

(30) Foreign Application Priority Data

Oct. 21, 2009 (DE) ..... 10 2009 050 176

(51) Int. Cl.

| | |
|---|---|
| ***B01F 7/00*** | (2006.01) |
| ***B01F 3/12*** | (2006.01) |
| ***B01F 7/08*** | (2006.01) |
| ***B01F 15/02*** | (2006.01) |

(52) U.S. Cl.

CPC ..... *B01F 3/1221* (2013.01); *B01F 7/00416* (2013.01); *B01F 7/082* (2013.01); *B01F 15/0251* (2013.01); *B01F 2215/0081* (2013.01)

(58) Field of Classification Search

CPC .... B01F 7/00208; B01F 5/02; B01F 7/00416; B01F 3/1221; B01F 7/082; B01F 15/0251; B01J 19/20

USPC ..... 366/20, 50, 21, 133, 9

See application file for complete search history.

(56) References Cited

U.S. PATENT DOCUMENTS

| | | | | |
|---|---|---|---|---|
| 1,731,953 | A * | 10/1929 | Thomson | 366/5 |
| 3,644,103 | A | 2/1972 | Yoon et al. | |
| 4,117,547 | A * | 9/1978 | Mathis et al. | 366/17 |
| 4,658,708 | A * | 4/1987 | Rastoin | 99/323.9 |
| 5,213,414 | A | 5/1993 | Richard et al. | |
| 5,634,715 | A | 6/1997 | Stehr et al. | |
| 6,170,667 | B1 | 1/2001 | Bilak et al. | |
| 7,575,071 | B2 | 8/2009 | Schauerte | |
| 2002/0125046 | A1 | 9/2002 | Schauerte | |
| 2007/0240907 | A1 | 10/2007 | Schauerte | |
| 2008/0041449 | A1 * | 2/2008 | Schauerte | 137/7 |

FOREIGN PATENT DOCUMENTS

| | | |
|---|---|---|
| CH | 521 782 | 6/1972 |
| DE | 199 18 775 B4 | 4/2000 |
| EP | 1 527 812 A1 | 5/2005 |
| FR | 2 452 581 | 10/1980 |
| FR | 2 610 847 | 8/1988 |
| GB | 600335 A | 4/1948 |
| JP | 11028311 | 2/1999 |

* cited by examiner

*Primary Examiner* — Tony G Soohoo
*Assistant Examiner* — Anshu Bhatia
(74) *Attorney, Agent, or Firm* — Howard IP Law Group, PC

(57) ABSTRACT

An apparatus for mixing a powdery medium with a fluid includes a mixing vessel which can be filled with the fluid and which has a feed for the fluid, an inlet for the powdery medium and an outlet for the fluid mixed with the powdery medium, and at least one mixing screw arranged inside the mixing vessel and driven by a rotary drive.

13 Claims, 1 Drawing Sheet

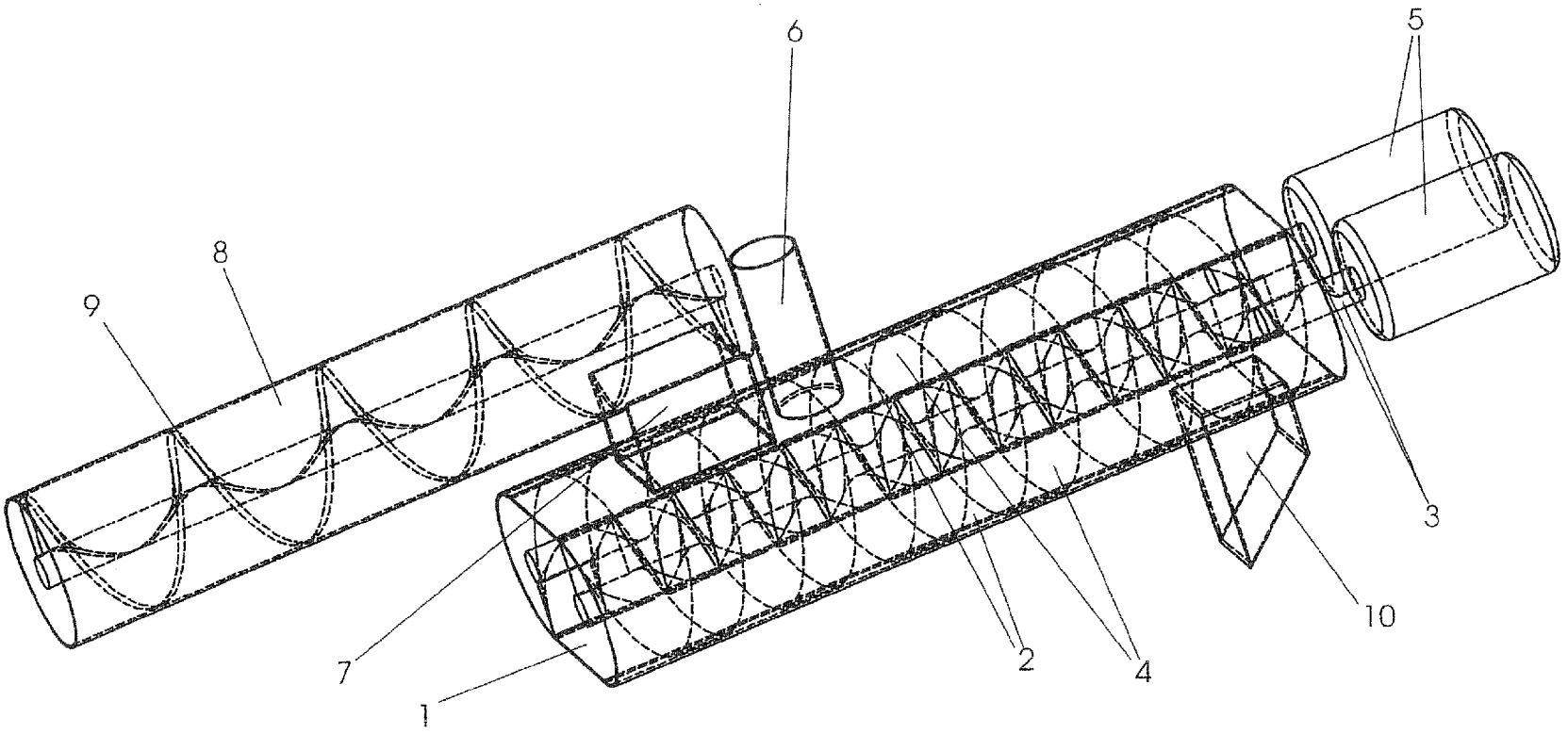
5
3
10
4
2
6
1
7
8
9

APPARATUS FOR MIXING A POWDERY MEDIUM WITH A FLUID

CROSS-REFERENCES TO RELATED APPLICATIONS

This application claims the priority of German Patent Application, Serial No. 10 2009 050 176.2, filed 21 Oct. 2009, pursuant to 35 U.S.C. 119(a)-(d), the content of which is incorporated herein by reference in its entirety as if fully set forth herein.

BACKGROUND OF THE INVENTION

The present invention relates to an apparatus for mixing a powdery medium with a fluid and to a mixing plant including such mixing apparatus.

The following discussion of related art is provided to assist the reader in understanding the advantages of the invention, and is not to be construed as an admission that this related art is prior art to this invention.

A drilling fluid is typically employed for supporting the drill feed when constructing ground drill holes and in particular horizontal drill holes. The drilling fluid is used to soften the ground in advance of the drill head of the drilling apparatus in order to improve the cutting performance of the drill head. The drilling fluid can also be used to lubricate the drill head and the drill rods, which are rotatably driven in the drill hole, so as to reduce friction with the ground. In addition, the drilling fluid can be used to flush out the soil removed by the drill head through the annular gap between the drill rod and the wall of the drill hole or through an annular gap of dual drill rods.

The drilling fluid is typically a mixture of water and bentonite, and sometimes several additives. Bentonite is a mixture of different clay materials, with the largest component being montmorillonite (generally with a content of 60% to 80%). Additional accompanying materials may be quartz, mica, feldspar, pyrite and sometimes also calcite. Due to the montmorillonite content, bentonite has strong water absorption and swelling capability.

Water into which bentonite has been stirred can have thixotropic characteristics, so that it behaves like a fluid when in motion, but like a solid structure when at rest. Because of this behavior, a drilling fluid composed of water and bentonite can also be used for supporting the wall of the drill hole, thereby preventing a collapse.

The introduction of bentonite into water poses a particular challenge, because the bentonite has the tendency to lump together in contact with water. The drilling fluid is therefore typically stirred in large storage vessels with dynamic mixing devices and thereafter transported in batches to the construction site where the drilling fluid is to be used. However, such batch-wise mixing is quite cumbersome. In addition, after the drill hole has been completed, the unused portion of the last batch must be disposed of, which is complex and expensive.

In another approach, the bentonite is introduced directly in the water in the region of a high-pressure pump, which is provided for transporting the drilling fluid through the drill rod to the drill head of a horizontal drilling apparatus, in order to take advantage of the turbulences produced in the water by the high-pressure pump for mixing the bentonite with the water. A swelling section can be arranged downstream of the high-pressure pump, where the bentonite-water-mixture is given time to swell before it is transported through the drill rod to the drill head.

It would therefore be desirable and advantageous to obviate prior art shortcomings and to provide an improved apparatus for introducing a powdery medium into a fluid or for mixing the powdery medium with the fluid, which is capable of alleviating and even eliminating problems associated with lumping of the powdery medium upon contact with the fluid.

SUMMARY OF THE INVENTION

According to one aspect of the present invention, an apparatus for mixing a powdery medium with a fluid includes a mixing vessel which can be filled with a fluid and which has a feed for the fluid, an inlet for the powdery medium and an outlet for the fluid mixed with the powdery medium. At least one mixing screw is arranged inside the mixing vessel which may, in one embodiment, be driven by a rotary drive.

The at least one mixing screw which is rotatably arranged inside a mixing vessel introduces the powdery medium into the mixing vessel where it is mixed with the likewise introduced fluid by imparting a helical rotation along the longitudinal axis, thus resulting in excellent intermixing.

According to the invention, the term "mixing screw" refers to a mixing element which imparts with its rotary motion a helical motion onto a fluid. More particularly, a mixing element refers to a mixing blade which twists about its rotation axis in a helical form, wherein the mixing blade may be continuous or discontinuous.

In one exemplary embodiment, at least one mixing screw may advantageously be constructed as a brushing screw. A brushing screw according to the invention may include a plurality of bristles, which can be of any type (e.g., made of metallic wire or plastic), arranged next to one another which are preferably arranged in a region of a mixing blade of the brushing screw or which are arranged on a core (e.g., a driveshaft) of the brushing screw and thus form the mixing blade itself. During the rotation of the brushing screw in the fluid to be mixed with the powdery medium, the large number of bristles and the (small) spaces formed between the bristles can produce increased swirling of the fluid, which can lead to excellent mixing of the fluid with the powdery medium.

In one advantageous embodiment, at least two brushing screws may be provided. The excellent mixing effect of the apparatus of the invention attained this way may be further improved by having the bristles at least partially mesh with each other.

Advantageously, mixing can additionally be improved if the mixing blade(s) of the two brushing screws have opposite pitch and/or are driven in opposite rotation directions.

To attain a desired mixing ratio of the fluid and the powdery medium, a metering device for the powdery medium may also be provided. The metering device may advantageously be a metering screw which is rotatably driven in a housing. By continuously transporting defined quantities of the powdery medium with the metering screw, a precisely regulated supply of the powdery medium into the mixing vessel can be provided. The use of a metering screw is particularly advantageous if simultaneously the fluid is continuously fed into the mixing vessel, as is the case for example in continuous mixing plants.

In another advantageous exemplary embodiment of the present invention, mixing of the powdery medium with the fluid may be improved with (additional) static or dynamic mixing elements. For example, one or more injector nozzles projecting into the mixing vessel may be provided, through which a pressurized gas may be introduced into the mixing vessel. The pressurized gas exiting from the injector nozzles into the mixing vessel can further intermix the fluid through turbulence and the particles of the powdery medium dispersed therein, thereby further improving mixing.

Alternatively or in addition, a similar effect may be produced by introducing into the mixing vessel ultra-sound waves with an ultrasound generator, thereby further improving intermixing of the fluid with the powdery medium.

An apparatus according to the invention is particularly suited for introducing bentonite into an aqueous fluid and particularly into (clean) water.

A mixing plant according to the invention for mixing a drilling fluid includes the aforedescribed (mixing) apparatus according to the invention and a water supply connected with the feed of the apparatus, a bentonite supply connected with the inlet of the apparatus, and a pump connected with the outlet of the apparatus.

Preferably, the pump of the mixing plant according to the invention may be a high-pressure pump which enables construction of a continuous mixing plant, because a high-pressure pump is capable of producing a pressure sufficient for transporting the drilling fluid through a (hollow) drill rod of a drill string (drill rod and drill head).

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 shows a mixing apparatus according to the invention in an isometric view.

DETAILED DESCRIPTION OF PREFERRED EMBODIMENTS

These depicted embodiments are to be understood as illustrative of the invention and not as limiting in any way. It should also be understood that the FIGURE is not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to FIG. 1, there is shown a mixing apparatus according to the invention which includes a mixing vessel 1 with a housing having a cross-section shaped as two partially overlapping circles. The purpose of this particular shape of the housing of the mixing vessel 1 is that each location has then the smallest possible distance between the housing and the bristles of two brushing screws 2 which are rotatably supported inside the mixing vessel 1.

Each of the brushing screws 2 has a driveshaft 3 on which a large number of bristles 4 made of metallic wire are attached. The bristles 4 are arranged on each respective driveshaft 3 so that they form a band which is helically wound about the driveshaft 3. The driveshafts 3 of the two brushing screws 2 are aligned in parallel and project from the mixing vessel at one end of the housing 2 through respective sealed openings, where the driveshafts 3 are then connected with the driveshaft of an electric motor 5 which drives the brushing screws 2 with a rotary motion. The bristle bands of the two brushing screws 2 have opposite winding sense, wherein the brushing screw 2 shown on the right side of FIG. 1 has a right-hand pitch and the left brushing screw 2 has a left-hand pitch. The two brushing screws 2 are also driven by the two electric motors 5 in opposite rotation directions. In addition to the embodiment illustrated in FIG. 1, where each of the two brushing screws 2 is driven by a separate electric motor, it is also possible to implement the drive of both brushing screws 2 with a single motor and a corresponding gear. The preferred opposite rotation directions of the two brushing screws 2 can also be implemented with the gear. It will be understood that other rotary drives (automatically or manually driven) can also be employed instead of the one or more electric motors 5.

The mixing vessel has in the forward third a feed 6 through which the water is introduced into the mixing vessel 1 from an unillustrated source. This region of the mixing vessel 1 also includes an inlet 7 through which bentonite is introduced into the mixing vessel 1 from an unillustrated reservoir. For metered introduction of the bentonite, a metering screw 9 is provided which is arranged in a housing 8 connected with the inlet 7. The metering screw 9 is rotated with an unillustrated drive depending on the quantity of the bentonite to be supplied. The drive can be controlled (with an unillustrated controller) depending on the height of the water inflow into the mixing vessel 1, which can be determined, for example, with suitable sensors (not illustrated).

A turbulent flow is imparted by the brushing screws 2 on the water entering the mixing vessel 1 through the feed 6 and the bentonite introduced through the inlet 7. The water is then transported to an outlet 10 disposed at the opposite end of the mixing vessel 1, wherein intense intermixing occurs. The bentonite-water mixture representing the drilling fluid is then discharged from the mixing apparatus through the outlet 10 and can be supplied, for example, to a high-pressure pump (at its suction or pressure side) of a continuous mixing plant of a drilling apparatus. The drilling fluid can be subjected in the high-pressure pump to such pressure that the drilling fluid is transported through a hollow drill rod to the drill head located at the front, exiting the drill head while still under a high-pressure.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An apparatus for mixing a powdery medium with a liquid, comprising:

an elongated mixing vessel having a longitudinal axis, a cross-section shaped as two partially-overlapping circles, and constructed to be filled with the liquid, the mixing vessel having a first end and a second end downstream along the longitudinal axis from the second end, a feed supplying the liquid into the mixing vessel near the first end, an inlet supplying the powdery medium into the mixing vessel upstream from the feed, an outlet discharging the liquid mixed with the powdery medium near the second end, at least two brushing screws arranged inside the mixing vessel, each brushing screw having an elongated driveshaft aligned with the longitudinal axis and a plurality of bristles arranged on the driveshaft to form a band helically wound about the driveshaft, wherein the bristles of the at least two brushing screws at least partially mesh;

wherein each location of the housing has a smallest possible distance between the housing and the bristles of the brushing screws.

2. The apparatus of claim 1, further comprising a rotary drive driving the at least two brushing screws.

3. The apparatus of claim 1, wherein the bands of bristles of the at least two brushing screws have opposite pitch.

4. The apparatus of claim 1, wherein the at least two brushing screws rotate in opposite rotation directions.

5. The apparatus of claim 1, further comprising a metering apparatus for the powdery medium connected with the inlet.

6. The apparatus of claim 5, wherein the metering apparatus comprises a housing and a metering screw which is rotatably driven in the housing.

7. The apparatus of claim 1, wherein the powdery medium comprises bentonite.

8. The apparatus of claim 1, wherein the liquid comprises an aqueous fluid.

9. A mixing system for mixing a powdery medium with a liquid, with an apparatus having a mixing vessel constructed to be filled with the liquid, the mixing vessel comprising:

an elongated housing having a longitudinal axis, a cross-section shaped as two partially-overlapping circles, a first end and a second end downstream along the longitudinal axis from the first end, a feed near the first end and supplying the liquid into the mixing vessel and connected with a water supply, an inlet upstream from the feed and supplying the powdery medium into the mixing vessel and connected with a bentonite supply, an outlet near the second end and connected with a pump for discharging the liquid mixed with the powdery medium, at least two brushing screws arranged inside the mixing vessel, each brushing screw having an elongated driveshaft aligned with the longitudinal axis and a plurality of bristles arranged on the driveshaft to form a band helically wound about the driveshaft, wherein the bristles of the at least two brushing screws at least partially mesh;

wherein each location of the housing has a smallest possible distance between the housing and the bristles of the brushing screws.

10. The mixing system of claim 9, wherein the pump comprises a high-pressure pump.

11. The apparatus of claim 1, further comprising one or more injector nozzles projecting into the mixing vessel, through which a pressurized gas is introduced into the mixing vessel for intermixing the liquid and the particles of the powdery medium dispersed therein through turbulence.

12. The mixing system of claim 9, further comprising one or more injector nozzles projecting into the mixing vessel, through which a pressurized gas is introduced into the mixing vessel for intermixing the fluid and the particles of the powdery medium dispersed therein through turbulence.

13. The apparatus of claim 1, wherein a driveshaft of a first one of the brushing screws is concentric with a center of a first one of the two partially-overlapping circles and a driveshaft of a second one of the brushing screws is concentric with a center of a second one of the two partially-overlapping circles.

* * * * *